US005152198A

United States Patent [19]

Schmitz, Jr.

[11] Patent Number: 5,152,198

[45] Date of Patent: Oct. 6, 1992

[54] SNAP LOCK ADJUSTABLE WRENCH

[76] Inventor: Herman C. Schmitz, Jr., 4259 Henley Dr., St. Louis, Mo. 63129

[21] Appl. No.: 797,681

[22] Filed: Nov. 25, 1991

[51] Int. Cl.[5] ..... B25B 13/14

[52] U.S. Cl. ..... 81/145; 81/132

[58] Field of Search ..... 81/142-145, 81/132, 134, 139, 128

[56] References Cited

U.S. PATENT DOCUMENTS

| | | | |
|---|---|---|---|
| 1,395,800 | 11/1921 | Cochran | 81/128 |
| 1,501,214 | 7/1924 | Garrison | 81/145 |
| 1,523,093 | 1/1925 | Wilcox | 81/145 |
| 1,792,338 | 2/1931 | Walz | 81/145 |
| 2,015,895 | 10/1935 | Hagbo | 81/145 X |
| 2,582,591 | 1/1952 | Hicks | 81/145 |
| 2,719,448 | 10/1955 | Bugge | 81/145 |
| 2,724,301 | 11/1955 | Parent et al. | 81/145 |
| 3,817,128 | 6/1974 | Evans | 81/145 |
| 4,214,491 | 7/1980 | Martinmaas | 81/142 X |
| 4,735,121 | 4/1988 | Coulson | 81/135 |

*Primary Examiner*—D. S. Meislin

*Attorney, Agent, or Firm*—Grace J. Fishel

[57] ABSTRACT

An adjustable wrench in which a slidable jaw is snapped toward a fixed jaw in an almost fully closed position by the force of a helical spring. The slidable jaw is not fully snapped closed to enable a close tolerance adjustment to be easily made for spacing requirements. The clutch teeth on the slidable jaw are locked in various equally spaced positions by counter acting locking teeth on an adjacent movable plate. The plate is held against the slidable jaw by a second helical spring located in the handle of the adjustable wrench.

14 Claims, 2 Drawing Sheets

SNAP LOCK ADJUSTABLE WRENCH

BACKGROUND

1. Field of Invention

This invention relates generally to the wrenching of fastener elements, specifically to a wrench with a wrenching configuration to adjust to any selected one of a variety of fastener element sizes.

2. Description of Prior Art

The following patents show slidable jaw wrenches which have devices for quick adjustment of the jaw span, but none of them provide a quick release and lock up device in the handle of the wrench. These wrenches also do not display the ease of construction and assembly used in the present invention. U.S. Pat. Nos. 2,582,591 to Hicks (1952); 3,817,128 to Evans (1974); and 4,735,121 to Coulson (1988).

One of the most popular wrenches today is the adjustable wrench with a sliding jaw toward and away from a fixed jaw, which can be adjusted to the size of any selected one of a variety of fastener elements within its range of travel. Crescent wrenches, which have been manufactured for many years suffer from loss of adjustment causing slippage and shearing of the fastener element. Another drawback is the fact that to adjust the wrench on a particular fastener element, the hand must be held at the jaws of the wrench. This forward adjustment can be very inconvenient, if not impossible in some cases where limited space exists.

OBJECTS AND ADVANTAGES

The purpose of this invention is to present an adjustable wrench in which a slidable jaw is snapped toward a fixed jaw with great accuracy and speed. Slippage is avoided by the clutch teeth on the slidable jaw and movable plate. Another purpose of this invention is to provide an adjustable wrench with fewer parts and simple assembly. This design will lower manufacturing costs and provide longer dependable use.

DRAWING FIGURES

The invention can be examined in more detail with the accompanying drawings.

DESCRIPTION FIGS. 1 TO 5

Figure 1:
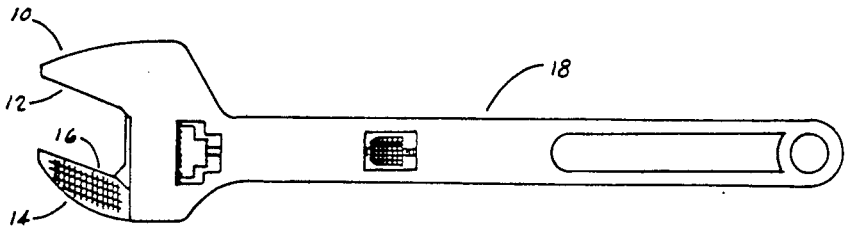
FIG. 1 is an elevation drawing of the wrench.
Figure 5:
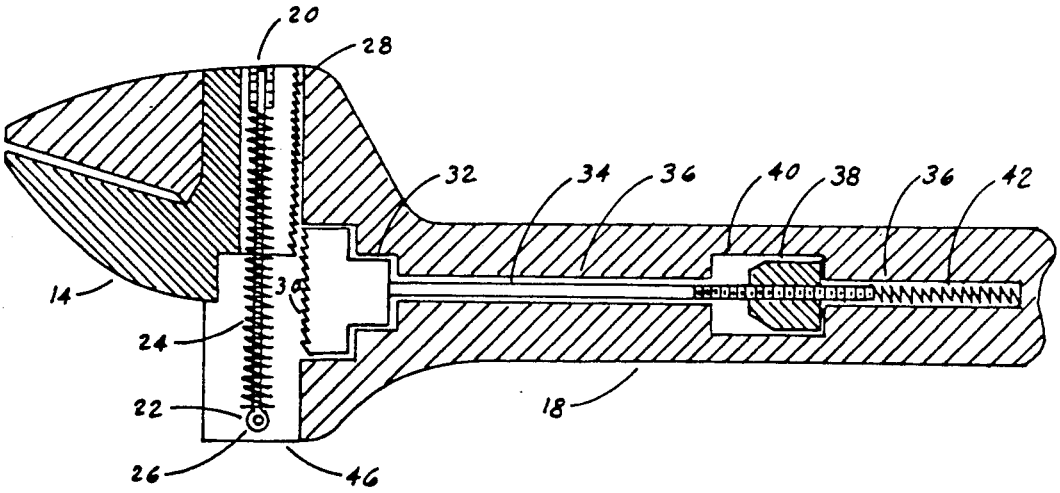
FIG. 5 is a cross section view similar to FIG. 4, but with the wrench unlocked in the almost fully closed position.

Referring to the drawings, and starting with FIG. 1 is a drawing of the wrench of the present invention. The adjustable wrench consists of a fixed member 10, a gripping surface 12, a slidable jaw member 14, a gripping surface 16, and an elongated handle 18. Looking at a cross section view in FIG. 5, the slidable jaw has a hollow set screw 20, mounted in the top of the slidable jaw member 14, a rod 22, flattened at one end, and a circular hole through the flattened end to receive the pin 26. A helical spring 24, is mounted on the rod 22, secured with a pin 26 through the rod and bottom of the wrench head 46. The rod and helical spring travel through the slidable jaw 14, and are held in place by the hollow set screw 20, in the top of the slidable jaw. A circular hole 54, clearly seen in FIG. 2, with a slightly larger diameter hole than the diameter of the helical spring 24, travels through the slidable jaw.

Figure 2:
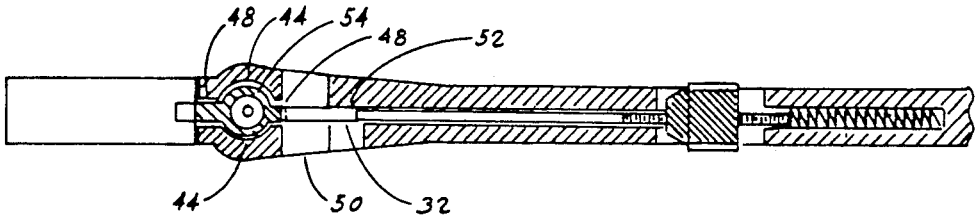
FIG. 2 is a cross section view taken along line 2—2 of FIG. 3.
Figure 3:
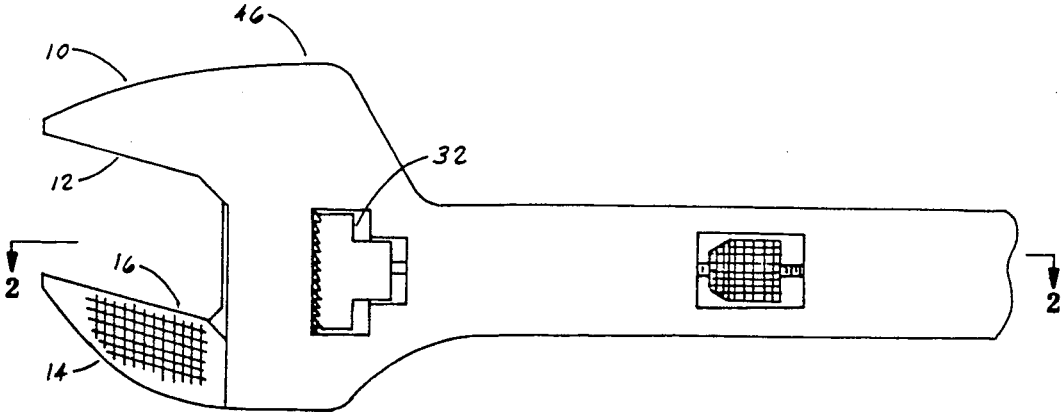
FIG. 3 is a partial elevation view of the wrench.
Figure 4:
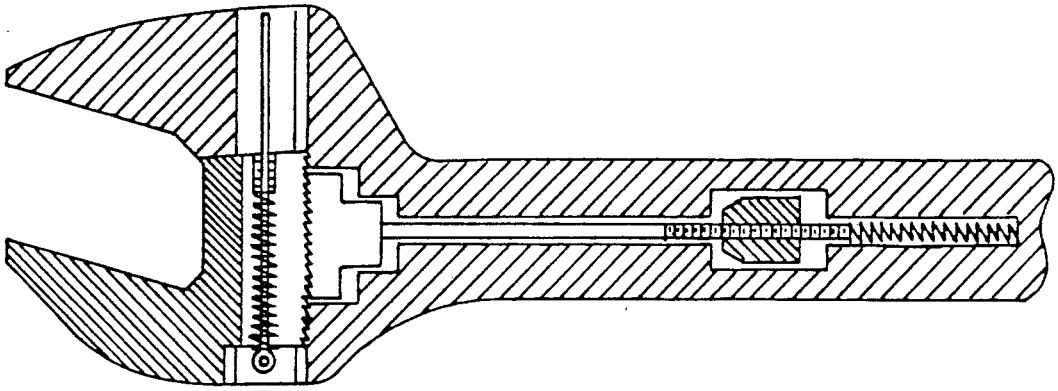
FIG. 4 is a cross section view with the wrench locked in the fully open position.

The clutch teeth 28, at the rear of the slidable jaw 14 are engaged with the opposing clutch teeth 30, at the front of the movable plate 32. The movable plate is mounted in the cavity of the wrench 50 FIG. 2, and against the recessed area 52 FIG. 2, which is a guide for the movable plate 32. Returning to FIG. 5, the movable plate 32 is seen with a threaded circular rod 34, passing through a slightly larger circular hole 36 in the wrench handle 18. A threaded knurled knob 38 is adjusted on the threaded rod 34 in a cavity 40, in the wrench handle 18. A helical spring 42 is positioned at the rear of the threaded rod 34 in the circular hole 36. An arc shaped cavity 44, as best seen in FIG. 2, runs through opposite sides of the wrench head 46. A slotted cavity 48 also runs through the wrench head 46, forward and rearward of the arc shaped cavity 44. These cavities provide a guide for the slidable jaw member 14.

OPERATION

The slidable jaw is snapped towards the fixed jaw in an almost fully closed position by the force of a helical spring. The Slidable jaw is not fully snapped closed to enable a close tolerance adjustment to be easily made for spacing requirements. The clutch teeth on the slidable jaw are locked in various equally spaced positions by counter acting locking teeth on an adjacent movable plate. The plate is held against the slidable jaw by a second helical spring located in the handle of the adjustable wrench.

The threaded knurled adjustable release knob located in the handle of the wrench can be adjusted in a vise grip fashion to remove all play and lock the wrench in an anti-shearing force mode, when high torque conditions are needed.

The wrench is unique in the fact that in its upright position, the angle of the jaws is reversed with respect to a conventional adjustable wrench. By designing the wrench in this fashion, it enables the clutch teeth on the slidable jaw and the movable plate to be parallel with each other and make direct contact. This also enables the movable plate to be perpendicular to the slidable jaw, allowing the vise grip mode to be applied with perpendicular force.

The wrench is easily assembled with a set screw in the top of the slidable jaw and a hole drilled in the center, enabling a guide rod to hold the helical spring in position. The pin at the base of the wrench holds the guide rod and helical spring at that point. The pin also acts as a stop for the slidable jaw when the wrench is in a fully open position.

The movable plate with the threaded rod attached can also be easily assembled by sliding the plate with the threaded rod attached through the front cavity of the adjustable wrench. With the helical spring inserted in the handle, the knurled knob can then be threaded and adjusted on the threaded rod.

Accordingly, the reader will see that the assembly of the adjustable wrench is easily accomplished. The small amount of parts and the ease of assembly will lower manufacturing costs. The clutch teeth and lock up mechanism in the handle of the wrench will provide accuracy, dependability and speed for the operator of the wrench.

The detailed description given above is for clarity of understanding the invention. No unnecessary limitations should be understood. Modifications in the design and construction may be necessary and obvious to those skilled in the art.

I claim:

1. An adjustable wrench which can be snapped and locked into place to conform to various fastener elements, said wrench comprising:

a head with a fixed jaw and an opposing slidable jaw, a resilient biasing means for urging the slidable jaw toward the fixed jaw, said slidable jaw having a row of clutch teeth, a cavity in the handle within which a movable plate is reciprocated along an axis generally parallel to the handle, said movable plate having a row of clutch teeth that can be brought in and out of mesh with the clutch teeth on the slidable jaw for locking the slidable jaw in a selected position with respect to the fixed jaw, said row of clutch teeth on the movable plate and said row of clutch teeth on the slidable jaw being substantially perpendicular to the axis along which the movable plate is reciprocated, a resilient biasing means for urging the movable plate toward the slidable jaw and a means for locking the slidable jaw in a selected position.

2. The wrench of claim 1 wherein the movable plate is mounted on an end of a threaded rod running into the cavity in the handle.

3. The wrench of claim 2 wherein the resilient biasing means for urging the movable plate is a helical spring located in the cavity in the handle, said helical spring pushing on an end of the threaded rod opposite the end attached to the movable plate.

4. The wrench of claim 2 wherein the means for locking the slidable jaw is a knurled knob threaded on the threaded rod and wherein the handle has a recess within which the knob has limited movement.

5. The wrench of claim 2 wherein a stop means limits the movement of the slidable jaw away from the fixed jaw.

6. An adjustable wrench which can snapped and locked into place to conform to various fastener elements, said wrench comprising:

a head with a fixed jaw and an opposing slidable jaw, said slidable jaw having an arm extending generally at a right angle thereto, said fixed jaw having a cavity within which the arm of a slidable jaw is reciprocated, a resilient biasing means for urging the slidable jaw toward the fixed jaw, said slidable jaw having a row of clutch teeth on the arm, a cavity in the handle within which a movable plate is reciprocated along an axis generally parallel to the handle, said movable plate having a row of clutch teeth that can be brought in and out of mesh with the clutch teeth on the arm of the slidable jaw for locking the slidable jaw in a selected position with respect to the fixed jaw, said row of clutch teeth on the movable plate and said row of clutch teeth on the arm of the slidable jaw being substantially perpendicular to the axis along which the movable plate is reciprocated, a resilient biasing means for urging the movable plate toward the slidable jaw and a means for locking the slidable jaw in a selected position.

7. The wrench of claim 6 wherein the arm of the slidable jaw has a hole passing through the arm generally parallel to the clutch teeth on the arm.

8. The wrench of claim 7 wherein the fixed jaw and the slidable jaw having gripping surfaces, said gripping surfaces being angled with respect to the handle.

9. The wrench of claim 7 wherein the slidable jaw has knurled side surfaces which serve as a finger and thumb grip.

10. The wrench of claim 7 wherein a beveled section connects a first end of the arm to the slidable jaw, said beveled section stopping the slidable jaw in an almost closed position against the fixed jaw.

11. The wrench of claim 7 wherein a rod is connected to the fixed jaw and passes through the hole in the arm of the slidable jaw, said resilient biasing means for urging the slidable jaw toward the fixed jaw comprising a helical spring fitted over the rod and confined within the hole in the arm.

12. The wrench of claim 11 wherein the helical spring is confined within the hole in the arm by a set screw with a hole in its center through which the rod passes but not the helical spring.

13. The wrench of claim 7 wherein a set screw with a hole in its center is threaded in the hole in the arm of the slidable jaw at the second end of the arm.

14. The wrench of claim 11 wherein the rod is connected to the fixed jaw by a pin which serves to stop movement of the slidable jaw away from the fixed jaw.

* * * * *